United States Patent [19]

Flury

[11] 4,167,964

[45] Sep. 18, 1979

[54] CONTINUOUS CASTING PLANT

[75] Inventor: Karl Flury, Winterthur, Switzerland

[73] Assignee: Escher-Wyss Limited, Zürich, Switzerland

[21] Appl. No.: 689,522

[22] Filed: May 24, 1976

[30] Foreign Application Priority Data

May 30, 1975 [CH] Switzerland ..... 006980/75

[51] Int. Cl.[2] ..... B22D 11/12; B21B 13/02; B21B 29/00

[52] U.S. Cl. ..... 164/448; 29/116 AD; 72/241

[58] Field of Search ..... 29/113 R, 113 AD, 115, 29/116 R, 116 AD; 72/241, 245, 201; 164/82, 282, 283 S, 447, 448, 442

[56] References Cited

U.S. PATENT DOCUMENTS

| | | | |
|---|---|---|---|
| 3,336,648 | 8/1967 | Alexeff | 29/113 AD |
| 3,389,588 | 6/1968 | Reinhardt et al. | 72/245 X |
| 3,802,044 | 4/1974 | Spillmann et al. | 29/113 AD |
| 3,919,753 | 11/1975 | Lehmann et al. | 29/113 AD |

FOREIGN PATENT DOCUMENTS

| | | | |
|---|---|---|---|
| 2408769 | 2/1974 | Fed. Rep. of Germany | 164/282 |
| 47-29695 | 8/1972 | Japan | 164/282 |
| 47-29694 | 8/1972 | Japan | 164/282 |
| 6509484 | 2/1966 | Netherlands | 29/113 AD |

*Primary Examiner*—Roy Lake
*Assistant Examiner*—John S. Brown
*Attorney, Agent, or Firm*—Pennie & Edmonds

[57] ABSTRACT

A plant for casting a continuous slab which comprises a slabbing train formed by a plurality of opposed rolls for guiding the slab therebetween. At least one of the rolls of the slabbing train is a deflection controlled roll having a roll shell rotatably mounted about a fixed beam and a plurality of hydraulic piston support elements disposed along the roll between the roll shell and the beam for exerting forces therebetween. The bearing surfaces of the support elements have recesses which are supplied with water under pressure. The water flowing from the recesses cools the roll shell and forms a hydrostatic cushion between the bearing surfaces of the support elements and the interior of the shell on which the roll shell is supported without direct contact with the support elements.

6 Claims, 3 Drawing Figures

CONTINUOUS CASTING PLANT

Figure 1:
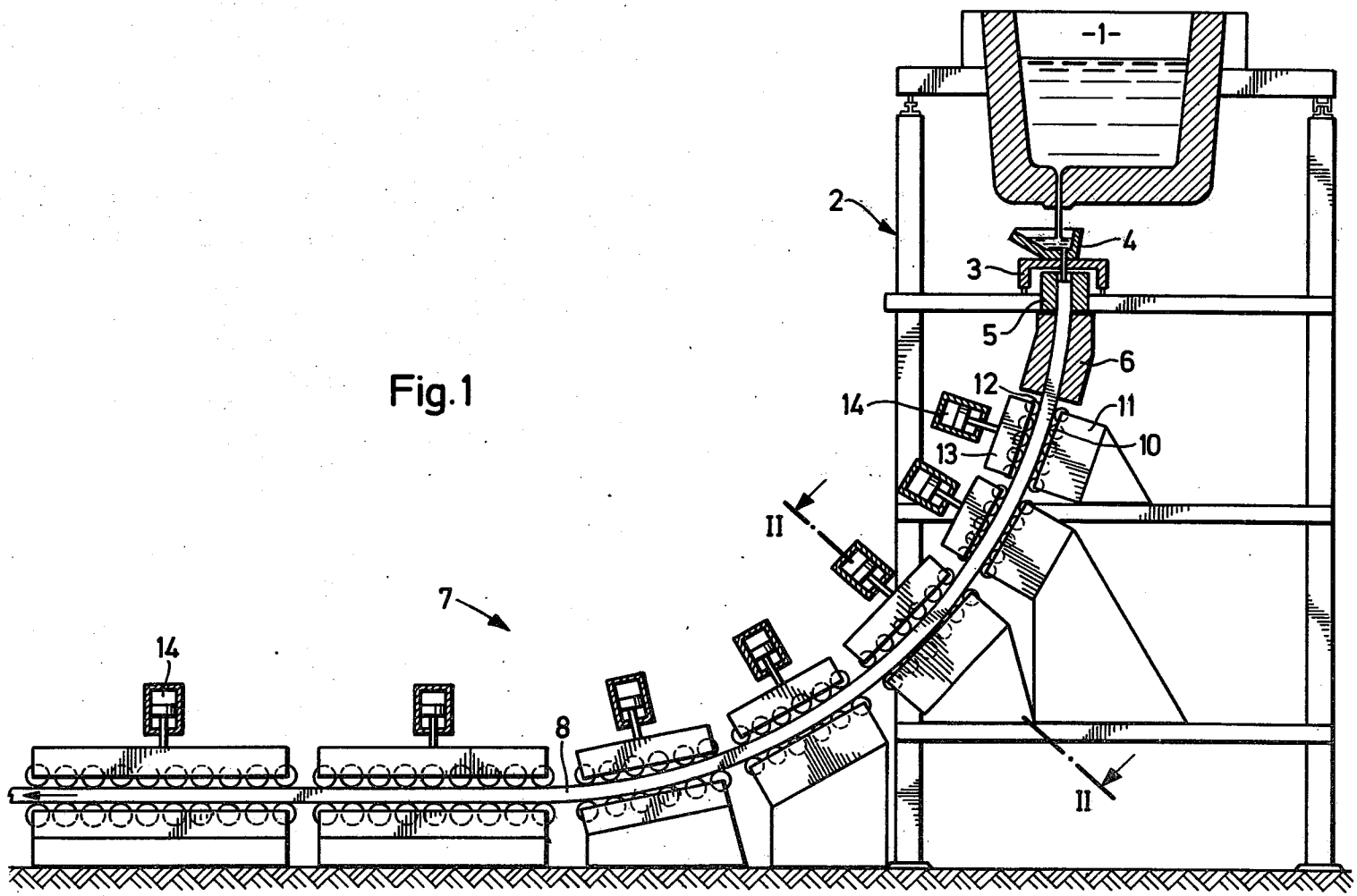

The invention relates to a continuous casting plant having a slabbing train formed by a plurality of opposed rolls.

In continous casting plants, the hot slab emerging from the mold cools slowly as it is guided along a train formed by a plurality of opposed rolls. The rolls of the slabbing train art thus subjected to very high temperatures through contact with the hot slab passing therebetween, as well as heavy loading. In order to avoid excessive sagging, the rolls of known casting plants are often divided axially and provided with intermediate bearings. There are, however, a number of problems associated with rolls of this type, especially in the design of the intermediate bearings which, during operation, are subjected to the same high temperatures as the rolls and in supplying cooling water to the individual rolls. Roll cooling is also a problem in rolls heretofore used in slabbing trains, since the cooling ducts formed in such rolls are often incapable of supplying coolant at sufficiently high rates for adequate cooling of the roll surfaces.

The object of the present invention is to obviate these problems by providing a slabbing train for a continuous casting plant in which the rolls are capable of exerting uniform contact-pressure across the width of the slab without the need for dividing the rolls or for using intermediate bearings, and in which the roll surfaces are cooled more intensively than was heretofore possible.

These objects are achieved in the casting plant of the invention by employing a slabbing train which comprises one or more deflection controlled rolls having a fixed beam, a roll shell rotatably mounted about the beam and a plurality of hydraulic piston support elements disposed along the roll between the beam and the shell for exerting forces therebetween. The bearing surfaces of the support elements are provided with recesses or pockets which are supplied with water under pressure which forms a hydrostatic cushion between the bearing surfaces of the support elements and the interior of the roll shell on which the shell is supported without direct contact with the support elements. At the same time, the flow of water from the pockets acts as a coolant for cooling the surface of the roll shell in contact with the hot slab.

The forces exerted by the support elements prevent the roll shell of the controlled deflection roll from sagging, so that a uniform contact-pressure is exerted across the full width of the slab without the need for axially dividing the roll. Furthermore, the water under pressure discharging from the pockets of the support elements flows through the bearing gap at a very high rate and therefore has a high cooling capacity. The rapid flow of water thus results in very intense cooling of the roll shell, enabling it to operate at very high temperatures. Moreover, because there is no sag in the rolls during operation, the thickness of the slab can be controlled with a high degree of accuracy.

Preferrably the support elements of the deflection controlled roll are divided into groups which are supplied with water under pressure by separate conduits containing pressure regulating devices. In this way, the roll shell support can be adjusted to accomodate slabs of varying widths by actuating all or only some of the groups of support elements.

According to another feature of the invention, a plurality of deflection controlled rolls in the slabbing train may be supplied with water from a common pressure feed pump through conduits at least some of which contain throttle elements for regulating the water pressure. Such an arrangement greatly simplifies the construction of the plant since only a few pumps suffice to supply the entire slabbing train with water.

Figure 2:
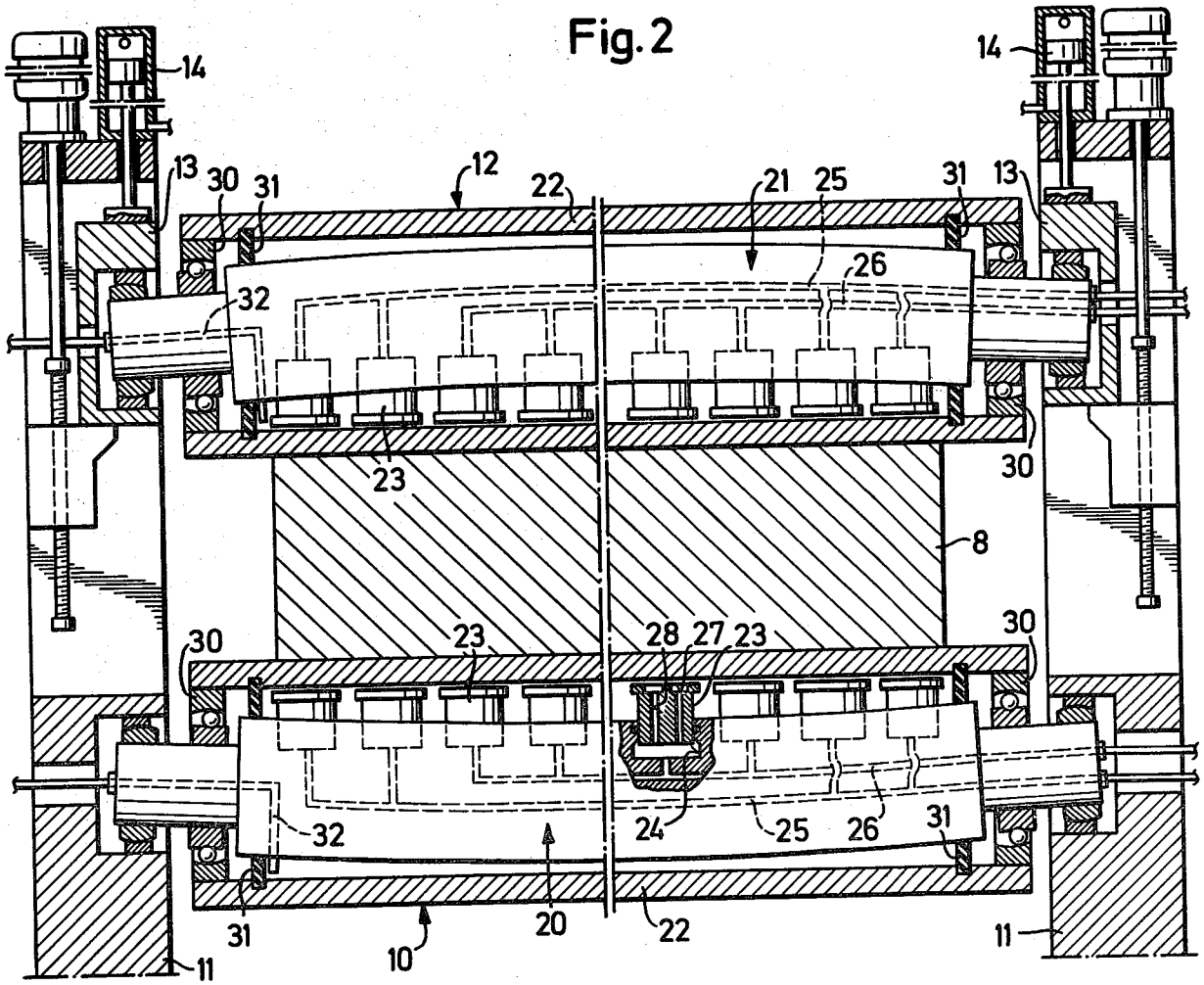
Figure 3:
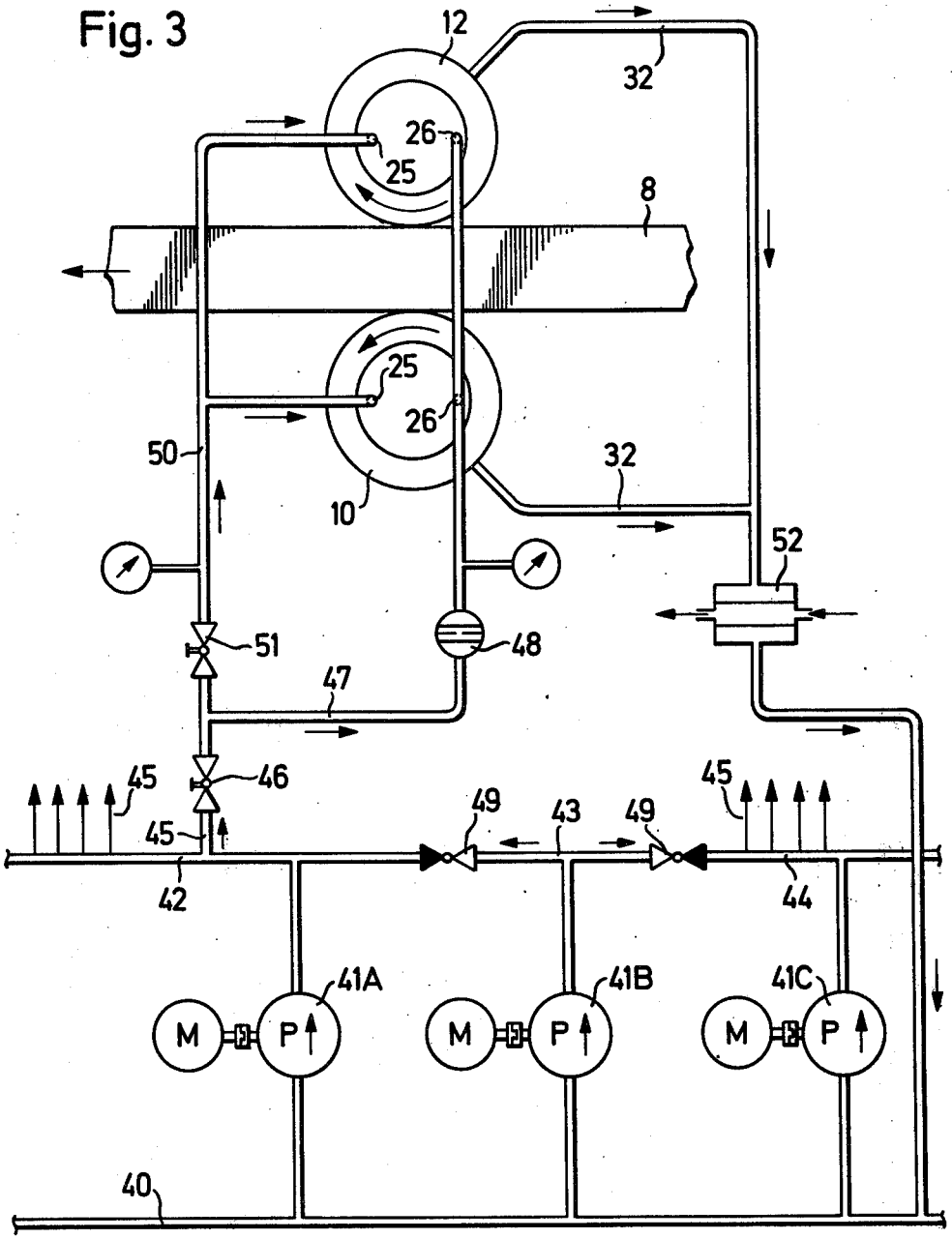

Further details of the invention will be apparent from the following description of exemplified embodiments with reference to the accompanying drawings wherein:

FIG. 1 diagrammatically illustrates a continuous casting plant to which the invention is applied;

FIG. 2 is a section on the line II—II of FIG. 1, of the slabbing train according to the present invention; and FIG. 3 diagrammatically illustrates the hydraulic circuit for the slabbing train of the invention.

Referring now to the drawings, FIG. 1 diagrammatically illustrates a continuous casting plant comprising a ladle 1, supported on a frame 2. Disposed beneath the ladle is a distributor truck 3, having a feed hopper 4 from which the molten metal is poured into molds 5 and 6. The slab 8, emerging from the molds, is guided along a slabbing train 7 divided into segments, each comprising a plurality of bottom rolls 10 mounted in a fixed frame 11, and a plurality of top rolls 12 mounted in a movable frame 13, which can be lifted from the slab 8 by means of hydraulic piston-cylinder mechanisms 14.

As shown in FIG. 2, which is a section through one of the segments of the slabbing train in accordance with the invention, the slab 8 is guided between two deflection controlled rolls 10 and 12. Each of the rolls 10 and 12 comprises a roll shell 22, rotatably mounted about the respective fixed support beams 20 and 21. The ends of the beam 20 of the lower roll 10 are supported in a fixed bearing frame 11, and the ends of the beam 21 of the upper roll 12 are supported in a movable bearing frame 13 which is connected to the pistons of hydraulic piston-cylinder mechanisms 14. The ends of the roll shells 22 are mounted on pivotable roller bearings 30, disposed about the respective fixed beams 20 and 21, and the shells are supported on hydrostatic support elements 23 arranged in a row along the lengths of the rolls 10 and 12.

The support elements 23 may preferrably be of the type described in U.S. Pat. No. 3,802,044, which are in the form of pistons seated in cylinder bores 24 formed in the fixed beams 20 and 21. The cylinders 24 of each roll are combined into two groups, one group comprised of cylinders disposed along the middle of the roll which are supplied with water under pressure via duct 26, and a second group comprised of cylinders disposed along the end portions of the roll which are supplied with water under pressure via duct 25. The bearing surfaces of the support elements 23 are provided with recesses or pockets 27 which are in fluid communication with the associated cylinder chambers 24 via throttle bores 28. Thus, the water under pressure supplied to the cylinders 24, via ducts 25 and 26, is fed, via throttle bores 28, to the pockets 27 of the support elements 23. The water flowing from the pockets 27 forms a hydrostatic cushion between the bearing surfaces of the support elements 23 and the interior of the roll shells 22 on which the shells are supported without direct contact with the support elements and at the same time the rapid flow of water through the bearing gap cools the roll shells which are heated through contact with the hot slab 8.

The water flowing from the support elements 23 is confined within the roll shells 22 by seals 31 disposed at the ends of the rolls and discharged therefrom through ducts 32, formed in beams 20 and 21.

As shown in FIG. 3, which illustrates the hydraulic circuit for the slabbing train of the invention, the cold water, which serves both as hydraulic pressure fluid for the support elements of the rolls and as coolant for the roll shells, is supplied via conduit 40, to pumps 41A, 41B, and 41C, which deliver the water under pressure to the respective pressure conduits 42, 43, and 44. Branch conduits 45, connected to the pressure conduits 42 and 44, lead respectively to different rolls or pairs of rolls of the slabbing train. The feed pump 41B, connected to conduit 43, acts as a back-up pump for pumps 41A and 41C. To this end, pressure conduit 43 is connected to the pressure conduits 42 and 44 through one-way valves 49 so that in the event of breakdown of pump 41A or 41C, pump 41B automatically delivers water under pressure to the respective conduit 42 or 44 and via branch lines 45 to the associated rolls of the slabbing train.

FIG. 3 also shows the water supply lines leading from one of the branch conduits 45 to a pair of deflection-controlled rolls 10 and 12. Conduit 45 is connected through a shut-off valve 46 to a pair of branch conduits 50 and 47. Branch line 50 contains a throttle valve 51 and is connected to ducts 25, which supply water under pressure to the cylinders 24 along the end portions of rolls 10 and 12, as shown in FIG. 2. Branch conduit 47 is connected via throttle 48 to ducts 26, supplying water under pressure to cylinders along the middle of rolls 10 and 12. The water discharge conduits 32 from the rolls 10 and 12 are connected with water cooler 52 from which the cooled water is returned to conduit 40.

During operation of the plant, the support elements 23 prevent the roll shells 22 from sagging, so that a uniform pressure is applied across the entire width of the continuous hot slab 8 passing between the controlled deflection rolls 10 and 12, while at the same time the rapid flow of water from the support elements cools the roll shells. The division of the hydrostatic support elements into groups which are supplied with water under pressure by separate branch conduits 47 and 50 containing pressure regulating devices 51 and 48 permits the rolls to accomodate slabs of varying widths. For example, if the width of the slab being cast is less than the full working width of the rolls, the forces exerted by the groups comprised of support elements along the ends of the rolls may be reduced by reducing the pressure of the water supplied thereto through an appropriate adjustment of throttle valve 51.

Furthermore, valve 51 and throttle element 48 permit the adjustment of the pressure of the water supplied to the rolls to suit the requirements of the particular roll or roll pair. For example, the rolls along the upstream portion of the slabbing train 7, because of the higher plasticity of the slab 8, require lower contact-pressure forces and therefore lower hydraulic pressure in the cylinder bores 24 of the support elements 23 than rolls along the downstream portions. The provision of throttle 48, thus permits a number of rolls having different hydraulic fluid pressure requirements to be supplied with water from a common feed pump.

I claim:

1. An apparatus for casting a continuous slab of metal material which comprises a slabbing train including a plurality of opposed rolls for guiding a hot cast metal slab therebetween, at least one of said rolls being a deflection controlled roll extending at least over the width of the cast slab of metal and having a fixed beam of generally cylindrical configuration and a generally cylindrical roll shell rotatably mounted about said beam, said beam defining at least two groups of generally cylindrical bores extending radially with respect to said beam and configured to receive hydraulic piston support elements, at least the first group being disposed in the generally central portion of the roll shell and at least the second group being disposed nearer to at least one end of the roll shell, each support element being disposed in relatively sealed relation within its associated cavity, said piston support elements having bearing surfaces facing the interior of said roll shell and provided with hydrostatic recesses therein, a throttling duct connecting each recess with the associated cavity, means for independently supplying water under pressure directly from a reservoir to preselected groups of said cavities for exerting forces through said piston support elements outwardly against said roll shell, means for independently regulating the pressure of the water supplied from said reservoir to said preselected groups to provide cooling of the roll shell and metal slab and to accommodate slabs of varying widths, said pressure water further being directed through said throttling ducts and through said recesses toward the interior of said roll shell so as to flow continuously between said bearing surfaces and the interior of said shell thereby forming a hydrostatic fluid cushion therebetween, the water continuously contacting interior surface portions of said roll shell thereby maintaining said bearing surfaces of said piston support elements in spaced relation with the interior of said roll shell and conducting heat transmitted by said metal slab to said roll shell, the dimension of the space being such as to cause the velocity of the water flowing therethrough to increase thereby providing intensive cooling for said roll shell while avoiding direct contact between said piston support elements and the interior of said roll shell during operation.

2. Apparatus according to claim 1, including separate conduit means for supplying water under pressure to different groups of said support elements, and means for independently regulating the pressure of the water supplied to at least one of said groups.

3. Apparatus according to claim 2, wherein said support elements disposed along the end portions of the roll form said one group and the support elements disposed along the middle of said roll form another group.

4. Apparatus according to claim 1, including sealing means disposed at each end of said deflection-controlled roll between said beam and said roll shell for containing the water flowing from said support elements within the roll shell and conduit means for discharging the water from said roll.

5. Apparatus according to claim 1, having a plurality of deflection controlled rolls supplied with water under pressure by conduit means from a common feed pump and means for regulating the pressure of the water supplied to at least one of said rolls.

6. Apparatus according to claim 5, wherein said pressure regulating means include a throttle element disposed in said conduit supplying water under pressure to said one roll.

* * * * *